US008704094B1

(12) United States Patent
Gebs et al.

(10) Patent No.: US 8,704,094 B1
(45) Date of Patent: Apr. 22, 2014

(54) TWISTED PAIR DATA CABLE

(75) Inventors: Bernhart Allen Gebs, Powder Springs, GA (US); Timothy William Waldner, Marietta, GA (US)

(73) Assignee: Superior Essex International LP, Atlanta, GA (US)

( * ) Notice: Subject to any disclaimer, the term of this patent is extended or adjusted under 35 U.S.C. 154(b) by 439 days.

(21) Appl. No.: 12/932,843

(22) Filed: Mar. 8, 2011

(51) Int. Cl.
*H01B 11/02* (2006.01)
*H01B 3/44* (2006.01)
*H01B 7/295* (2006.01)

(52) U.S. Cl.
USPC ..... 174/113 R; 174/34; 174/110 PM; 174/110 R; 174/113 C

(58) Field of Classification Search
USPC ..... 174/113 R, 34, 110 PM, 110 R, 113 C
See application file for complete search history.

(56) References Cited

U.S. PATENT DOCUMENTS 5,493,071 A * 2/1996 Newmoyer ..... 174/113 R
5,744,757 A * 4/1998 Kenny et al. ..... 174/113 R
5,770,820 A * 6/1998 Nelson et al. ..... 174/113 R
5,814,768 A * 9/1998 Wessels et al. ..... 174/110 FC
6,323,427 B1 * 11/2001 Rutledge ..... 174/113 R
2003/0150638 A1 * 8/2003 Patel ..... 174/113 R
2004/0118593 A1 * 6/2004 Augustine et al. ..... 174/113 R
2008/0251276 A1 * 10/2008 Clark et al. ..... 174/113 R
2009/0014202 A1 * 1/2009 Clark et al. ..... 174/113 R
2009/0272571 A1 * 11/2009 Gromko et al. ..... 174/378
2013/0213686 A1 8/2013 Qibc Jiang

* cited by examiner

*Primary Examiner* — Timothy Thompson
*Assistant Examiner* — Sherman Ng

(57) ABSTRACT

A communication cable can comprise twisted pairs of electrical conductors for transmitting electrical signals, such as for digital communication or data transmission. The pairs can be twisted to different tightness in connection with managing interference among the pairs. Within the cable, a separator having an economical polymeric composition can maintain the pairs in a desired orientation. The pairs can be insulated with polymeric materials that compensate for relaxed electrical characteristics of the economical polymeric composition of the separator. One or more pairs having relatively tight twist can be insulated with a premium polymeric material that provides a relatively high level of electrical performance. One or more pairs twisted less tightly can be insulated with another polymeric material providing somewhat lesser but still sufficient electrical performance.

20 Claims, 3 Drawing Sheets

TWISTED PAIR DATA CABLE

FIELD OF THE TECHNOLOGY

The present invention relates to communication cables comprising multiple twisted pairs of electrical conductors for transmitting communication signals, and more specifically to cables in which pairs are twisted at different rates and insulated with different polymers.

BACKGROUND

The escalating desire for enhanced communication bandwidth presses transmission media to convey information at higher speeds while maintaining signal fidelity and avoiding crosstalk. Additionally, the market expects cost reduction to accompany such advances in performance.

A single communication cable may be called upon to transmit multiple communication signals over respective electrical conductors concurrently. Such a communication cable may have two or more twisted pairs of insulated electrical conductors ("twisted pairs"). A flexible member extending internally within the cable may help maintain these twisted pairs in a desirable orientation. Each pair may be twisted to a different twist length or "lay length" in order to control interference associated with signal energy coupling between or among the pairs, including through the flexible member. The materials of the flexible member and the insulation of the twisted pairs affect this interference. Materials offering improved electrical performance typically have higher costs. Meanwhile, the flexible member and the pair insulation materials account for a substantial portion of cost of a cable.

Accordingly, need exists for technology to impart a cable with enhanced signal performance economically. A capability addressing such need or some other related deficiency in the art would support cost effective communications and elevate bandwidth that a communication cable can carry cost effectively.

SUMMARY

In one aspect of the present invention, a communication cable can comprise multiple electrical conductors for transmitting multiple communication signals concurrently. The communication signals can comprise digital or discrete signal levels supporting digital communication, for example. The communication cable can comprise twisted pairs of insulated electrical conductors that extend lengthwise along the cable. A flexible member running lengthwise within the cable can maintain the twisted pairs in a desirable orientation. The pairs can be twisted to different lengths towards controlling or avoiding interference among the twisted pairs. Pairs having tighter twist can be insulated with premium materials offering high electrical performance. With such elevated electrical performance of the tightly twisted pairs, the flexible member can be made from economical material that could otherwise compromise cable performance. Pairs twisted less tightly, and thus less susceptible to the economical material of the flexible member, can be insulated with materials having relaxed electrical performance relative to the premium insulation.

The foregoing discussion of materials and configurations for twisted pair cables is for illustrative purposes only. Various aspects of the present invention may be more clearly understood and appreciated from a review of the following detailed description of the disclosed embodiments and by reference to the drawings and the claims that follow. Moreover, other aspects, systems, methods, features, advantages, and objects of the present invention will become apparent to one with skill in the art upon examination of the following drawings and detailed description. It is intended that all such aspects, systems, methods, features, advantages, and objects are to be included within this description, are to be within the scope of the present invention, and are to be protected by the accompanying claims.

Figure 1:
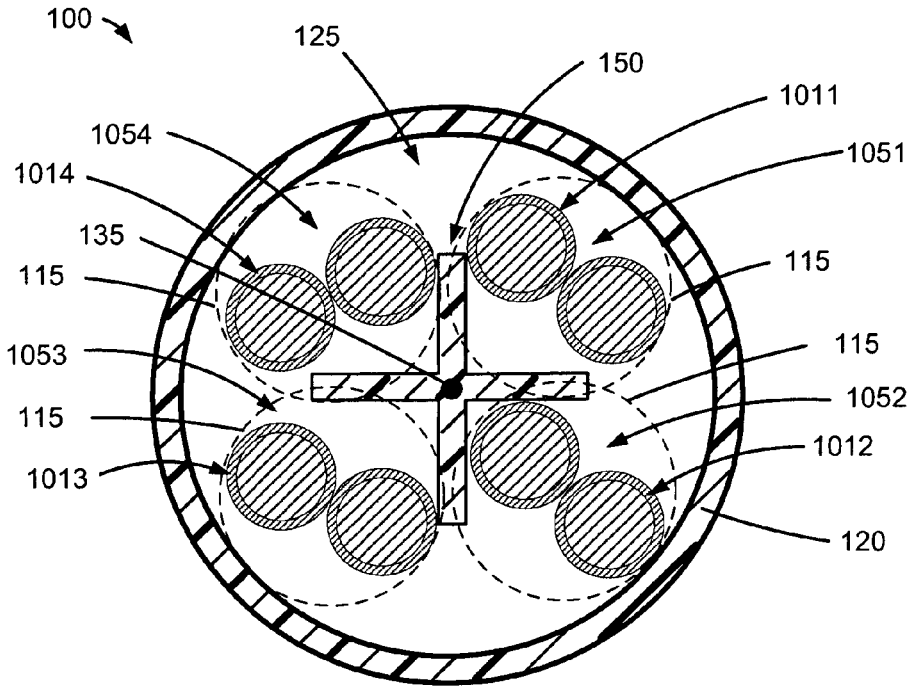
FIG. 1 is a cross sectional view of an exemplary communication cable that comprises four twisted pairs of electrical conductors having different insulation and different twist lengths in accordance with certain embodiments of the present invention.

Many aspects of the invention can be better understood with reference to the above drawings. The elements and features shown in the drawings are not to scale, emphasis instead being placed upon clearly illustrating the principles of exemplary embodiments of the present invention. Moreover, certain dimensions may be exaggerated to help visually convey such principles. In the drawings, reference numerals designate like or corresponding, but not necessarily identical, elements throughout the several views.

DETAILED DESCRIPTION OF EXEMPLARY EMBODIMENTS

Technology for cost effective management of electrical performance of twisted pairs of a communication cable will now be described more fully with reference to FIGS. 1-4, which illustrate representative embodiments of the present invention. FIGS. 1, 2, 3, and 4 describe exemplary features of a communication cable comprising twisted pairs having different twist lengths and different insulation materials.

The invention can be embodied in many different forms and should not be construed as limited to the embodiments set forth herein; rather, these embodiments are provided so that this disclosure will be thorough and complete, and will fully convey the scope of the invention to those having ordinary skill in the art. Furthermore, all "examples" or "exemplary embodiments" given herein are intended to be non-limiting and among others supported by representations of the present invention.

Turning now to FIG. 1, this figure illustrates a cross sectional view of a communication cable 100 that comprises four twisted pairs 105 (1051, 1052, 1053, 1054) of electrical conductors having different insulation 101 (1011, 1012, 1013, 1014) and different twist lengths according to certain exemplary embodiments of the present invention.

A jacket 120 typically having a polymer-based composition seals the communication cable 100 from the environment and provides strength and structural support. In one exemplary embodiment, the jacket 120 has an outer diameter of about 0.205 inches and a wall thickness of about 0.016 inches. In various embodiments, the jacket 120 comprises polymeric material, polyvinyl chloride ("PVC"), polyurethane, one or more polymers, a fluoropolymer, polyethylene, neoprene, cholorosulphonated polyethylene, fluorinated ethylene propylene ("FEP"), flame retardant PVC, low temperature oil resistant PVC, polyolefin, flame retardant polyurethane, flexible PVC, or some other appropriate material known in the art, or a combination thereof, for example. In certain exemplary embodiments, the jacket 120 can comprise flame retardant and/or smoke suppressant materials. Outfitted with such materials or other materials having suitable fire properties, the illustrated communication cable 100 can be deployed in plenum applications and/or designated as a plenum cable.

The jacket 120, which extends lengthwise along the communication cable 100, can be single layer or have multiple layers. In certain exemplary embodiments, a tube or tape (not illustrated) can be disposed between the jacket 120 and the twisted pairs 105. Such a tube or tape can be made of polymeric or dielectric material, for example. In various embodiments, the jacket 120 can be characterized as an outer jacket, an outer sheath, a casing, a circumferential cover, or a shell.

The communication cable 100 can comprise shielding or may be unshielded, as FIG. 1 illustrates. In certain exemplary embodiments, a metallic foil or other electrically conductive material can cover the twisted pairs 105 and/or the cable core 125 to provide shielding. In certain exemplary embodiments, the communication cable 100 can be shielded with a system of electrically isolated patches of shielding material, for example as described in U.S. patent application Ser. No. 12/313,914, entitled "Communication Cable Comprising Electrically Isolated Patches of Shielding Material." The entire contents of U.S. patent application Ser. No. 12/313, 914, entitled "Communication Cable Comprising Electrically Isolated Patches of Shielding Material" are hereby incorporated herein by reference.

A metallic material, whether continuous or comprising electrically conductive patches, can be disposed on a substrate, such as a tape placed between the twisted pairs 105 and the jacket 120, or adhered to the jacket 120. For example, shielding, whether continuous or electrically isolated, can be disposed or sandwiched between the jacket 120 and a tube or tape that is disposed between the jacket 120 and the twisted pairs 105. In certain embodiments, the jacket 120 comprises conductive material and may be or function as a shield. In certain embodiments, the jacket 120 comprises armor, or the communication cable 100 comprises a separate, outer armor for providing mechanical protection.

In the illustrated embodiment, the cable core 125 of the communication cable 100 contains four twisted pairs 105, four being an exemplary, rather than limiting, number. Other exemplary embodiments may have fewer or more twisted pairs 105. The twisted pairs 105 extend along the longitudinal axis 135 of the communication cable 100 within the cable core 125.

Each twisted pair 1051, 1052, 1053, 1054 can carry data or some other form of information, for example in a range of about one to ten Giga bits per second ("Gbps") or at another appropriate speed, whether faster or slower. In certain exemplary embodiments, each twisted pair 1051, 1052, 1053, 1054 supports data transmission of about two and one-half (2.5) Gbps (e.g. nominally two and one-half Gbps), with the communication cable 100 supporting about ten Gbps (e.g. nominally ten Gbps). In certain exemplary embodiments, each twisted pair 1051, 1052, 1053, 1054 supports data transmission of about ten Gbps (e.g. nominally ten Gbps), with the communication cable 100 supporting about forty Gbps (e.g. nominally forty Gbps). In certain exemplary embodiments, the communication cable 100 carries about twelve and one-half Gbps.

The illustrated communication cable 100 can convey four distinct channels of information simultaneously, one channel per twisted pair 1051, 1052, 1053, 1054. In certain exemplary embodiments, the metallic conductor diameter of each twisted pair 1051, 1052, 1053, 1054 can be in a range of about 0.0223 inches to about 0.0227 inches. In certain exemplary embodiments, the outer, insulation diameter covering each metallic conductor can be in a range of about 0.0385 inches to about 0.0395 inches, for example. As will be discussed in further detail below, the insulation 101 (1011, 1012, 1013, 1014) covering the electrical conductors of the twisted pairs 105 can comprise materials selected according to pair twist length.

As will be discussed in further detail below, at least two of the twisted pairs 1051, 1052, 1053, 1054 have different twist rates (twists-per-meter or twists-per-foot). That is, at least two of the twisted pairs 1051, 1052, 1053, 1054 have different twist lengths or twist lays, which can be characterized in units of centimeters-per-twist, inches-per-twist, or inches-per-lay. In certain exemplary embodiments, each of the twisted pairs 1051, 1052, 1053, 1054 has a different twist length.

In the illustrated view, each twisted pair 1051, 1052, 1053, 1054 sweeps out a respective twist path 115 as it twists/rotates, with the twist paths 115 generally circular when viewed end-on as illustrated. (The twist paths 115 are illustrated in approximation.)

In certain exemplary embodiments, the differences between twist rates of twisted pairs 105 that are circumferentially adjacent one another (for example the twisted pair 1051 and the twisted pair 1052) are greater than the differences between twist rates of twisted pairs 105 that are diagonal from one another (for example the twisted pair 1051 and the twisted pair 1053). As a result of having similar twist rates, the twisted pairs 105 that are diagonally disposed can be more susceptible to crosstalk issues than the twisted pairs 105 that are circumferentially adjacent. The different twist lengths can help reduce crosstalk among the twisted pairs 105. Additionally, electrical performance demands, including interference issues, can be associated with tighter pair twisting.

The cable core 125 can be filled with a gas such as air (as illustrated) or alternatively a gelatinous, solid, powder, moisture absorbing material, water-swellable substance, dry filling compound, or foam material, for example in interstitial space between the twisted pairs 105. Other elements can be added to the cable core 125, for example one or more optical fibers, additional electrical conductors, additional twisted pairs, or strength members, depending upon application goals.

In the illustrated embodiment, the communication cable 100 comprises a flexible member 150 that maintains a desired orientation of the twisted pairs 105 to provide beneficial signal performance. In an exemplary embodiment, the flexible member 150 can be a pair separator. The illustrated embodiment of the flexible member 150 has a cross sectional geometry resembling a plus sign. Various embodiments may be shaped like an "X," a "T," a "Y," a "J," a "K", an "L" an "I," or have a form of a flat strip, or a circular cross section, or comprise two or three or more fins, for example. In certain exemplary embodiments, the communication cable 100 may not include a flexible member for maintaining geometric orientation of the twisted pairs 105.

In various exemplary embodiments, the flexible member 150 can comprise polyvinyl chloride (PVC) (typically but not necessarily low-smoke PVC), polypropylene, polyethylene, FEP, ethylene chlorotrifluoroethlyene ("ECTFE"), or some other suitable polymeric or dielectric material, for example. In various exemplary embodiments, the flexible member 150 can consist of, or substantially consist of, PVC, polypropylene, polyethylene, FEP, ECTFE, or some other suitable polymeric or dielectric material, for example. The flexible member 150 can be filled, unfilled, foamed, un-foamed, homogeneous, or inhomogeneous and may or may not comprise additives. The flexible member 150 can comprise flame retardant and/or smoke suppressant materials. In certain exemplary embodiments, the strip 155 is crosslinked. The flexible member 150 can be extruded, pultruded, or formed in another appropriate process known in the art.

The flexible member 150 can have a substantially uniform composition, can be made of a wide range of materials, and/or can be fabricated in a single manufacturing pass. Further, the flexible member 150 can be a composite and can include one or more strength members, fibers, optical fibers, metallic conductors, cavities, threads, or yarns. Additionally, the flexible member 150 can be hollow to provide a cavity that may be filled with air or some other gas, gel, fluid, moisture absorbent, water-swellable substance, dry filling compound, powder, an optical fiber, a metallic conductor, shielding, or some other appropriate material or element.

In certain exemplary embodiments, the flexible member 150 can comprise electrically conductive patches that are electrically isolated from one another to provide one or more shields. Such patches can adhere to a surface of the flexible member 150, for example.

In certain exemplary embodiments, the flexible member 150 has a polymeric composition having a propensity or a capability to diminish or degrade electrical performance of at least one of the twisted pairs 1051, 1052, 1053, 1054 at an operating frequency or data rate of the communication cable 100. In such embodiments, at least one of the twisted pairs 1051, 1052, 1053, 1054 can be insulated with a material that addresses, mitigates, or overcomes such electrical performance degradation. In certain embodiments, one or more of the twisted pairs 1051, 1052, 1053, 1054 are configured such that they are particularly susceptible to diminished electrical performance associated with interaction with the flexible member 150. The insulation 101 (1011, 1012, 1013, 1014) of the specific twisted pair or pairs 1051, 1052, 1053, 1054 with such susceptibility can have a premium composition that overcomes the susceptibility.

In certain exemplary embodiments, the twisted pairs 1051 and 1053 are twisted more tightly and thus have shorter twist lengths than the twisted pairs 1052 and 1054. With such twisting, the twisted pairs 1051 and 1053 can be more sensitive than the twisted pairs 1052 and 1054 to a composition of the flexible member 150 that includes a substantial level of PVC or another economical polymeric material. To overcome this sensitivity, the insulation 1011 and 1013 of the twisted pairs 1051 and 1053 can have improved electrical properties relative to the insulation 1012 and 1014 of the twisted pairs 1052 and 1054. In certain exemplary embodiments, the insulations 1011, 1012, 1013, 1014 all comprise FEP, with the insulations 1011 and 1013 having a composition or grade of FEP that electrically outperforms the insulations 1012 and 1014. Accordingly, the insulations 1011, 1012, 1013, 1014 can have fluoropolymers providing two (or more) performance levels.

For example, the flexible member 150 can comprise PVC, be based on PVC, or have a composition that is at least 70 percent, 80 percent, 90 percent, 95 percent, 99 percent PVC or in a range between any two of these values. (In certain embodiments, such percentages are on a volume basis. In certain embodiments, such percentages are on a weight basis.) In certain exemplary embodiments, the flexible member 150 is formed from a material available from Teknor Apex of Pawtucket, R.I. under the product identifier "910A-34-NL" and the registered mark "FIREGUARD." Table 1 below provides exemplary properties for this material, as provided by the supplier.

TABLE 1

Exemplary Properties for the Flexible Member

| Properties | U.S. Units/Metric | Test Method |
|---|---|---|
| Hardness (Shore 'C' Duro +/−3) 10 Second Reading | 82/82 | ASTM D-2240 |
| Specific Gravity +/−0.02 | 1.66/1.66 | ASTM D-792 |
| Tensile Strength, psi (MPa) | 2276/15.7 | ASTM D-638 |
| Elongation, % | 235/235 | ASTM D-638 |
| Brittle Point, ° C. | −8 | ASTM D-746 |
| Dielectric Constant @ 1 kHz. @ 1 MHz. | 4.67/3.67 | ASTM D-150 |
| Dissipation Factor @ 1 kHz. @ 1 MHz. | 0.068/0.032 | ASTM D-150 |
| Oxygen Index (%) | 52.5 | ASTM D-2863 |
| Dynamic Heat Stability @ 205 2 ° C., 100 RPM, 72 gr. #5 Bowl (Mins. to Decomposition) | 56 | ASTM D-2538 |
| Kayeness ACR @ 350 ° F., 1000 sec−1 (Pa-sec) | 362 | ASTM D-3835 |
| Cone Calorimeter @ 75 kW/m2) | | |
| Peak Heat Release Rate (kW/m2) | 110.8 | |
| Avg. Heat Release Rate (kW/m2) | 57.1 | |
| Total Heat Released (MJ/$m_2$) | 66 | ISO-5660 |
| Avg. Heat of Combustion (MJ/kg) | 10.5 | |
| Avg. Specific Extinction Area ($m_2$/kg) | 142 | |
| Peak Smoke (1/m) | 1.29 | |
| Maximum Operating Temperature, ° C. | 75 | |
| Suggested Melt Temperature, ° F. | 385 | |

In certain embodiments, the flexible member 150 and the jacket 120 can comprise common polymeric materials, for example both being based on PVC. Accordingly, the flexible member 150 can have a substantial content of PVC or another economical polymeric material that may negatively impact data transmission fidelity or quality, such as associated with interplay between tightly twisted pairs and the flexible member 150. To mitigate or alleviate such negative impact, one or more tightly twisted pairs can be insulated with polymeric insulation material that is premium relative to loosely twisted pairs.

Figure 2:
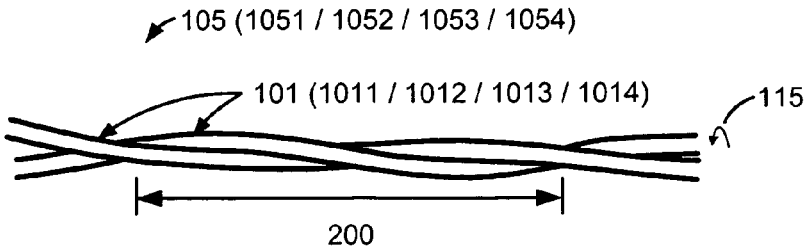
FIG. 2 is an illustration of an exemplary twisted pair of a communication cable in accordance with certain embodiments of the present invention.

Turning now to FIG. 2, this figure illustrates a twisted pair 105 (1051, 1052, 1053, 1054) of the communication cable 100 according to certain exemplary embodiments of the present invention. The twisted illustrated twisted pair 105 has a twist length 200 (which may also be characterized as twist lay). For example, if the insulated electrical conductors 201 and 202 of the illustrated pair 105 (1051, 1052, 1053, 1054) are twisted together so as to revolve around one another two times-per-inch, the twist rate would be two twists-per-inch, and the twist length or lay length would be one-half inch. In certain exemplary embodiments, each of the twisted pairs 1051, 1052, 1053, 1054 of the communication cable 100 has a different twist length 200. In certain exemplary embodiments, the twist lengths 200 of the twisted pairs 105 (1051, 1052, 1053, 1054) can be in a range of about 0.250 to 0.800 inches, 0.280 to 0.420 inches, or 0.350 to 0.475 inches, for example.

In various exemplary embodiments, the twisted pairs 105 can have a common twist direction that is clockwise or counterclockwise. In certain embodiments, at least one of the twisted pairs 1051, 1052, 1053, 1054 can be twisted in a clockwise direction, while other ones are twisted counterclockwise. Accordingly, the twisted pairs 105 may have a "left hand lay" or a "right hand lay" or a combination thereof.

As discussed above, material compositions and electrical performances of the insulation 101 (1011, 1012, 1013, 1014) of the twisted pairs 105 (1051, 1052, 1053, 1054) can be selected according to twist length 200. In this manner, economical insulation and premium insulation can be incorporated where appropriate.

Figure 3:
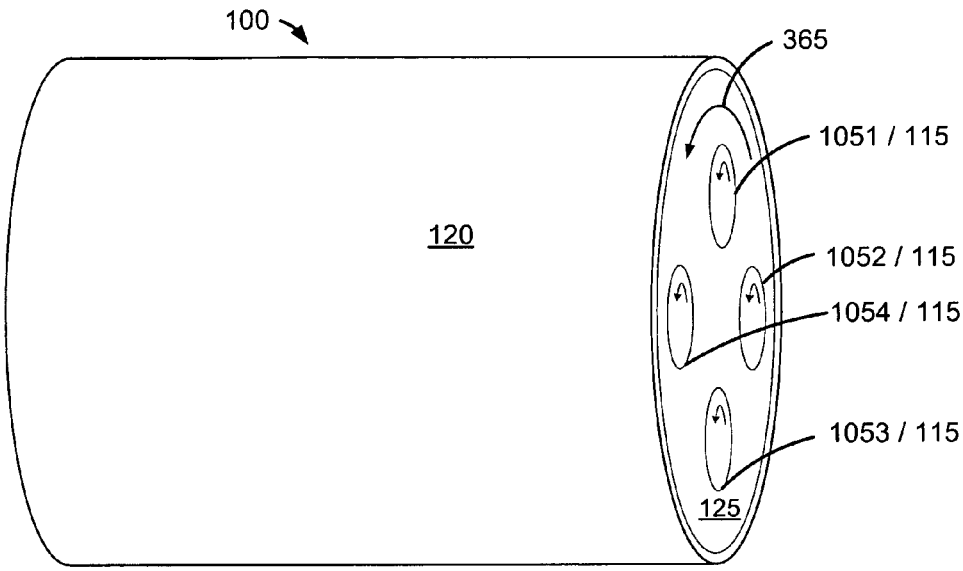
FIG. 3 is an illustration depicting exemplary twists of a communication cable in accordance with certain embodiments of the present invention.

Turning now to FIG. 3, this figure illustrates twists of the communication cable 100 according to certain exemplary embodiments of the present invention. In the illustrated embodiment of FIG. 3, the core 125 has a twist 365 in a direction that is common to the pair twist. Thus, the core 125 and the twisted pairs 1051, 1052, 1053, 1054 can each have left hand lay or twist in counterclockwise direction as illustrated. Alternatively, the core 125 and the twisted pairs 1051, 1052, 1053, 1054 can each have right hand lay or twist in clockwise direction. Accordingly, the four twisted pairs 1051, 1052, 1053, 1054 can be collectively twisted about a longitudinal axis 135 (see FIG. 1) of the communication cable 100 in a common direction.

Figure 4:
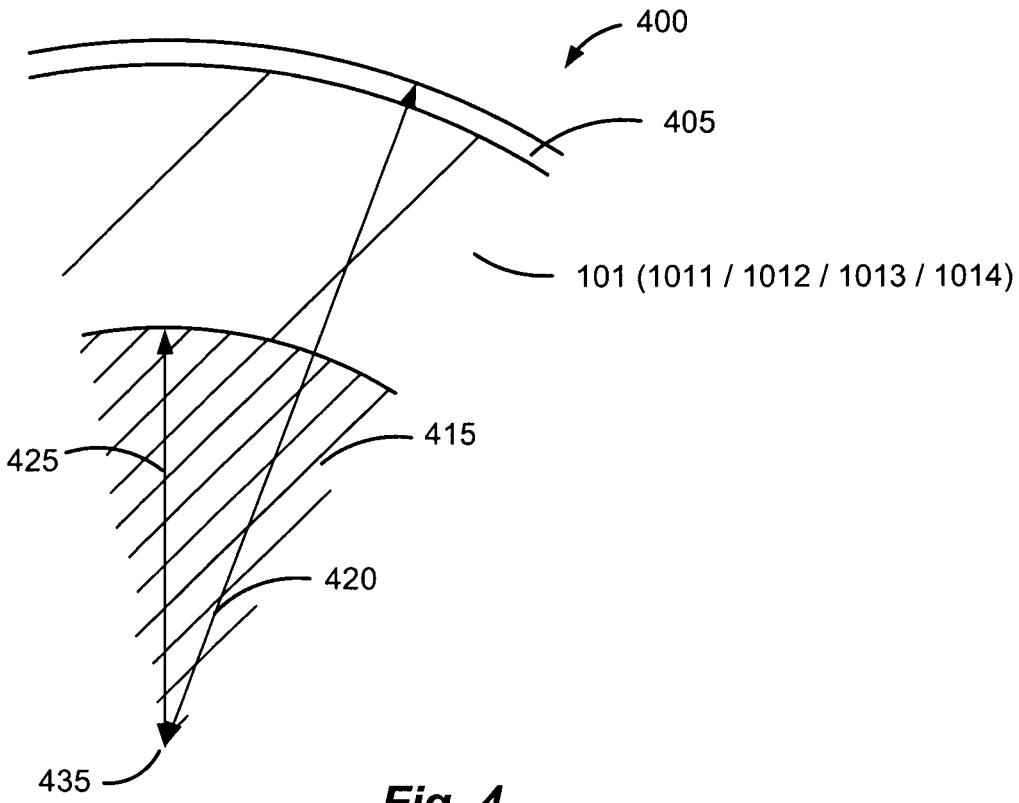
FIG. 4 is an illustration depicting exemplary insulation covering an electrical conductor of a twisted pair in accordance with certain embodiments of the present invention.

Turning now to FIG. 4, this figure illustrates insulation 101 (1011, 1012, 1013, 1014) covering an electrical conductor 415 of a twisted pair 105 (1051, 1052, 1053, 1054) according to in certain exemplary embodiments of the present invention. In certain exemplary embodiments, the insulation 101 (1011, 1012, 1013, 1014) comprises a skin 405 covering a foamed region.

In certain exemplary embodiments, the electrical conductors 415 of the communication cable 100 can have consistent or common diameters (twice the illustrated radius 425 that extends from the center axis 435 radially outward), for example being manufactured to a common specification. Alternatively, in certain exemplary embodiments, the electrical conductors 415 of different twisted pairs 105 can have different diameters. In certain exemplary embodiments, the electrical conductors 415 can be 22, 23, or 24 AWG (American Wire Gauge). In certain exemplary embodiments, the electrical conductors 415 can have a diameter in a range of about 0.0201 to 0.0253 inches, for example.

In certain exemplary embodiments, the insulated electrical conductors 400 of each twisted pair 1051, 1052, 1053, 1054 within the communication cable 100 can have an outer diameter (twice the illustrated radius 420) that is consistent or common. Alternatively, in certain exemplary embodiments, the insulated electrical conductors 400 of the communication cable 100 can have different insulation thicknesses. In certain exemplary embodiments, the thickness of the insulation 101 (1011, 1012, 1013, 1014) can be in a range of about 0.007 to 0.015 inches, for example.

As discussed above, the compositions of the insulation 101 (1011, 1012, 1013, 1014) of the twisted pairs 105 (1051, 1052, 1053, 1054) typically differs in accordance with twist length 200. In one exemplary embodiment of the communication cable 100, the insulation 101 and 103 of the twisted pairs 1051 and 1053 comprises an FEP-based material providing a relatively high electrical performance and those twisted pairs 1051 and 1053 have a substantially tighter twist than the twisted pairs 1052 and 1054. Such a material is available from Daikin America Inc. of Decatur, Ala. under the product identifier "NP-1105." Table 2 below provides exemplary properties for this material, as provided by the supplier. Meanwhile, the insulation 1012 and 1014 of the twisted pairs 1052 and 1054 comprises an FEP-based material offering lower electrical performance, but lower cost, and those twisted pairs 1052 and 1054 have a substantially looser twist than the twisted pairs 1051 and 1053. Such a material is available from Daikin America Inc. under the product identifier "NP-102." Table 3 below provides exemplary properties for this material, as provided by the supplier. The flexible member 125 for this embodiment of the communication cable 100 can have the properties and composition reflected in Table 1, as discussed above. As shown in exemplary Tables 2 and 3, the insulation 1011 and 1013 exhibits a substantially reduced dissipation factor at 2.5 GHz as compared to the insulation 1012 and 1014. Thus, the twisted pairs 1051 and 1053 can be twisted more tightly and operated in proximity of the flexible member 125 without sacrificing electrical performance. Accordingly, the communication cable 100 can achieve tight cost constraints by utilizing economical polymeric materials where feasible and incorporating premium polymeric materials strategically to offset performance issues otherwise associated with economical materials utilization.

TABLE 2

Exemplary Properties for Premium Insulation

| Properties | Test Method | Values | Units |
|---|---|---|---|
| Specific gravity | ASTM 2116 | 2.14-2.17 | N/A |
| Melt Flow Rate | ASTM 2116 | 19-26 | g/10 min. |
| Melting Point | ASTM 2116 | 250-60 | ° C. |
| Tensile Strength Minimum | ASTM 2116 | 20 (2900) | MPa ( Psi) |
| Elongation Percent | ASTM 2116 | 280 minimum | % |
| Thermal Conductivity | C117 | 6 × 10-4 | (cal/sec/cm$^2$, ° C./cm) |
| Maximum Continuous Temperature Use | | 200 | ° C. |
| Dielectric Constant | D150/$10_3$ | 2.1 | |
| | D150/$10_6$ | 2.1 | |
| Dissipation Factor | @ 2.4 GHz | 4 E-4 | |
| Chemical resistance | | Excellent | |
| Weatherability | | Excellent | |
| Combustibility | D2863/Oxygen Concentration Index | >95 | % |
| Contact Angle | Angle to level | 114 | Degrees |
| Flex Life | MIT | 5000 | Cycles |

TABLE 3

Exemplary Properties for Premium Insulation

| | | | |
|---|---|---|---|
| Specific gravity | ASTM 2116 | 2.12-2.17 | N/A |
| Melt Flow Rate | ASTM 2116 | 23.0-30.0 | g/10 min. |
| Melting Point | ASTM 2116 | 250-265 | ° C. |
| Tensile Strength Min. | ASTM 2116 | 20 (2900) | MPa (Psi) |
| Elongation Percent | ASTM 2116 | 275-400 | % |
| Thermal Conductivity | C117 | 6 × 10-4 | (cal/sec/cm2, ° C./cm) |
| Melt Viscosity | | 4 × $10_4$ ~$10_5$ (300 ~ 330°) | Poise |
| Coef. of Linear Expansion | D696/23° ~60° | 8.3 ~10.5 × 10-5 | (1/° C.) |
| Max. Cont. Temp. Use | | 200 | ° C. |
| Compression Strength | D695/1% Def., 25° C. | 5~6 | MPa |

TABLE 3-continued

| Exemplary Properties for Premium Insulation | | | |
|---|---|---|---|
| Flexural Modulus | D790/23° C. | 539–637 | MPa |
| Hardness | Durometer | D55 | (Shore) |
| Deformation Under Load | D621/100° C., 6.8 MPa, 24 h | 5.0 | % % |
| | D621/25° C., 13.7 MPa, 24 h | 3.0 | |
| Impact Strength | D256/23° C., Izod | No break | (ft-lb/in) |
| Static Friction Coef. | Coated Steel Surface | 0.05 | N/A |
| Dielectric Constant | $D150/10^3$ $D150/10^6$ | 2.1 2.1 | |
| Dissipation Factor | @ 2.4 GHz | 9 E-4 | |
| Diel. Breakdown Strength | D149 short time ⅛ in | 500–600 | V/mil |
| Volume Resistivity | D257 | $<10^{18}$ | Ohm-cm |
| Chemical resistance | | Excellent | |
| Weatherability | | Excellent | |
| Combustibility | D2863/Oxygen Conc. Index | >95 | % |
| Contact Angle | Angle to level | 114 | Degrees |
| Flex Life | MIT | 5000 | Cycles |
| Critical Shear Rate | (360–400° C.) | 60–130 | Sec−1 |

From the foregoing, it will be appreciated that an embodiment of the present invention overcomes the limitations of the prior art. Those skilled in the art will appreciate that the present invention is not limited to any specifically discussed application and that the embodiments described herein are illustrative and not restrictive. From the description of the exemplary embodiments, equivalents of the elements shown herein will suggest themselves to those skilled in the art, and ways of constructing other embodiments of the present invention will suggest themselves to practitioners of the art. Therefore, the scope of the present invention is to be limited only by the claims that follow.

What is claimed is:

1. A communication cable comprising:

a jacket defining an interior space that extends lengthwise about a longitudinal axis of the communication cable;

a first plurality of electrical signal conductors that are individually insulated with a first polymeric material having a first dissipation factor in its solid state and comprising fluorinated ethylene propylene, wherein the first plurality of electrical signal conductors are twisted together to provide a first twist length;

a second plurality of electrical signal conductors that are individually insulated with a second polymeric material having a second dissipation factor in its solid state and comprising fluorinated ethylene propylene, the second polymeric material and the first polymeric material having dielectric constants that are approximately equal in their solid states, wherein the second plurality of electrical signal conductors are twisted together to provide a second twist length that is substantially longer than the first twist length, and wherein the second dissipation factor is substantially greater than the first dissipation factor; and a flexible member extending lengthwise along the longitudinal axis, between the first plurality of electrical signal conductors and the second plurality of electrical signal conductors.

2. The communication cable of claim 1, wherein the flexible member comprises polyvinyl chloride.

3. The communication cable of claim 1, further comprising a third plurality of electrical signal conductors that are individually insulated with the first polymeric material and that are twisted together.

4. The communication cable of claim 1, further comprising a third plurality of electrical signal conductors that are individually insulated with the second polymeric material and that are twisted together.

5. The communication cable of claim 1, further comprising:

a third plurality of electrical signal conductors that are individually insulated with the first polymeric material; and a fourth plurality of electrical signal conductors that are individually insulated with the second polymeric material.

6. The communication cable of claim 1, wherein the first and second polymeric materials are selected to compensate for the second twist length being substantially longer than the first twist length and for electrical performance of the flexible member.

7. A communication cable comprising:

a first and a second pair of twisted electrical conductors that are insulated with a first polymeric composition comprising a fluorinated ethylene propylene having a first dielectric constant and a first dissipation factor;

a third and a fourth pair of twisted electrical conductors that are insulated with a second polymeric composition comprising fluorinated, ethylene propylene with a second dielectric constant approximately equal to the first dielectric constant and having a second dissipation factor substantially lower than the first dissipation factor to provide substantially elevated electrical performance relative to the first polymeric composition, wherein each of the third and the fourth pair is twisted substantially more tightly than each of the first and the second pair;

a flexible member extending lengthwise along a longitudinal axis of the communication cable and operable for pair positioning; and a polymeric jacket circumscribing the flexible member and the first, the second, the third, and the fourth pair.

8. The communication cable of claim 7, wherein the flexible member comprises polyvinyl chloride.

9. The communication cable of claim 7, wherein the first dissipation factor and the second dissipation factor differ by about a factor of two.

10. The communication cable of claim 7, wherein the substantially elevated electrical performance compensates for twist difference and electrical performance of the flexible member.

11. The communication cable of claim 7, wherein the flexible member comprises polyvinyl chloride, wherein the first and second pair have different twist lays, wherein the third and fourth pair have different twist lays, and wherein the first dissipation factor is substantially higher than the second dissipation factor at a frequency that the cable is operable to carry.

12. The communication cable of claim 1, wherein the first dissipation factor is about one-half of the second dissipation factor.

13. A communication cable comprising:

a first and a second pair of twisted electrical conductors that are insulated with a first polymeric composition having a first dissipation factor;

a third and a fourth pair of twisted electrical conductors that are insulated with a second polymeric composition having a dielectric constant approximately equal to that of the first polymeric composition and a second dissipation factor substantially lower than the first dissipation factor to provide substantially elevated electrical performance relative to the first polymeric composition, wherein each of the third and the fourth pair is twisted substantially more tightly than each of the first and the second pair;

a flexible member extending lengthwise along a longitudinal axis of the communication cable and operable for pair positioning; and a polymeric jacket circumscribing the flexible member and the first, the second, the third, and the fourth pair.

14. The communication cable of claim 13, wherein both the first polymeric material and the second polymeric material comprise fluorinated ethylene propylene.

15. The communication cable of claim 13, wherein the flexible member comprises polyvinyl chloride.

16. The communication cable of claim 13, wherein the first dissipation factor and the second dissipation factor differ by about a factor of two.

17. The communication cable of claim 13, wherein the substantially elevated electrical performance compensates for twist difference and electrical performance of the flexible member.

18. The communication cable of claim 13, wherein the flexible member comprises polyvinyl chloride, wherein the first and second pair have different twist lays, wherein the third and fourth pair have different twist lays, and wherein the first dissipation factor is substantially higher than the second dissipation factor at a frequency that the cable is operable to carry.

19. The communication cable of claim 7, wherein the first dielectric constant and the second dielectric constant are approximately equal for the solid states of the first polymeric composition and the second polymeric composition.

20. The communication cable of claim 13, wherein the dielectric constants of the first polymeric composition and the second polymeric composition are approximately equal for the solid states of the polymeric compositions.

* * * * *